US012740614B2

(12) United States Patent
Enes

(10) Patent No.: US 12,740,614 B2
(45) Date of Patent: Sep. 22, 2026

(54) VENTILATION APPARATUS FOR SHOES AND ADDITIONAL CLOTHING

(71) Applicant: Paul Enes, Wembley (CA)

(72) Inventor: Paul Enes, Wembley (CA)

( * ) Notice: Subject to any disclaimer, the term of this patent is extended or adjusted under 35 U.S.C. 154(b) by 0 days.

(21) Appl. No.: 19/077,661

(22) Filed: Mar. 12, 2025

(65) Prior Publication Data

US 2026/0272104 A1 Sep. 17, 2026

(51) Int. Cl.
*A43B 7/06* (2006.01)

(52) U.S. Cl.
CPC ..... *A43B 7/06* (2013.01)

(58) Field of Classification Search
CPC ..... A43B 7/06; A43B 7/08; A43B 7/082
USPC ..... 36/3 B
See application file for complete search history.

(56) References Cited

U.S. PATENT DOCUMENTS 5,408,760 A 4/1995 Tse
9,936,763 B2 4/2018 Semperlotti
D833,082 S 11/2018 Kusnier
2005/0178023 A1* 8/2005 Hammonds ..... A43B 7/081 36/29
2009/0044431 A1 2/2009 Hypponen
2011/0167679 A1* 7/2011 Graziani ..... A43B 7/081 36/3 R
2014/0102573 A1 4/2014 Larocque
2015/0201700 A1* 7/2015 Jang ..... A43B 7/06 36/3 B
2019/0013755 A1* 1/2019 Stach ..... H02J 7/0068
2020/0214387 A1* 7/2020 Yepez ..... A43B 7/081
2023/0079373 A1* 3/2023 Deiana ..... A43B 7/085 36/3 B

FOREIGN PATENT DOCUMENTS

WO WO2006084947 8/2006

* cited by examiner

*Primary Examiner* — Timothy K Trieu

(57) ABSTRACT

A wearable ventilation apparatus for ventilating an interior of a shoe and a space between a user's body and an article of clothing includes a shoe which has a chamber housed inside the shoe that may be compressed to release air into a foot-receiving space of the shoe. A tube with a one-way valve places the chamber in fluid communication with an external atmosphere and only permits airflow from the external atmosphere into the chamber. The chamber is biased to fill with air when the user lifts the foot wearing the shoe, which thereby removes weight that would otherwise compress the chamber. An extension tube may attach to the tube in the shoe to draw air from the space between the user's body and the article of clothing.

15 Claims, 7 Drawing Sheets

VENTILATION APPARATUS FOR SHOES AND ADDITIONAL CLOTHING

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to personal ventilation devices and more particularly pertains to a new personal ventilation device for ventilating an interior of a shoe and a space between a user's body and an article of clothing.

(2) Description of Related Art Including Information Disclosed Under 37 CFR 1.97 and 1.98

The prior art discloses various shoes which ventilate via stepping on a compressible chamber in a sole of a shoe to expel air into the shoe. However, the prior art does not describe such a shoe in which an insole defining a top wall of the compressible chamber has apertures for releasing air against a foot which are distributed evenly between a front end and a rear end of the insole. The prior art also fails to disclose an apparatus which includes an extension tubing apparatus for supplying air to the chamber from a gap between a user's body and a clothing article worn by the user.

BRIEF SUMMARY OF THE INVENTION

An embodiment of the disclosure meets the needs presented above by generally comprising a shoe which includes an outsole, an upper mounted atop the outsole, and an insole mounted between the upper and the outsole. A chamber is defined between the insole and the outsole, and a foot-containing space is defined between the insole and the upper. The insole has a plurality of apertures extending therethrough from the chamber to the foot-containing space. The insole is movable toward the outsole to compress the chamber and is biased away from the outsole to facilitate expansion of the chamber to a resting state. The apertures are distributed evenly between a front end and a rear end of the insole. A shoe tube extends between a first end which is open at the chamber and a second end which is open to an external atmosphere such that the chamber is in fluid communication with the external atmosphere via the shoe tube. A one-way valve is mounted to the shoe tube and is configured to permit air to move only from the second end of the shoe tube to the first end of the shoe tube.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
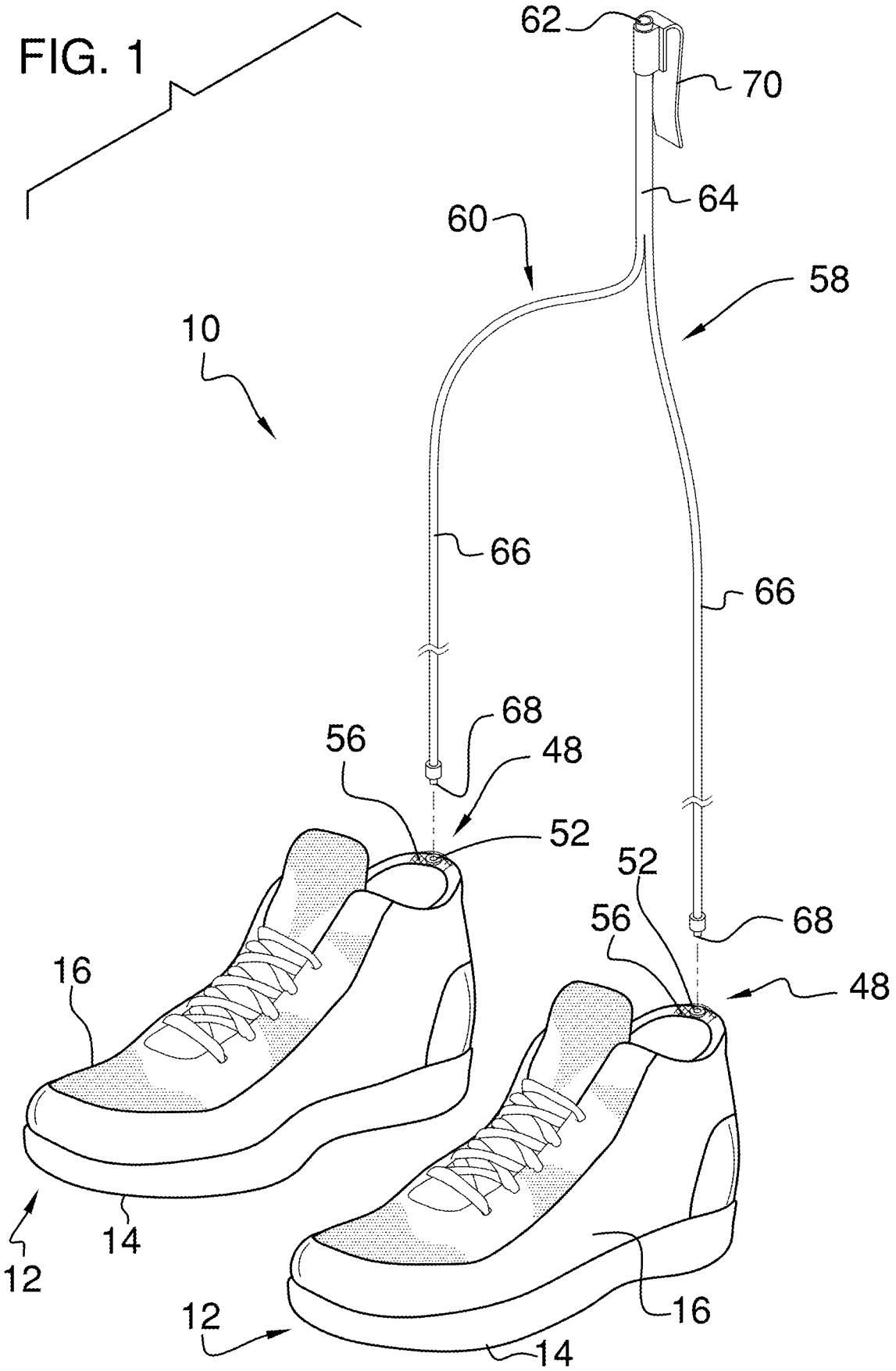
FIG. 1 is an exploded perspective view of a wearable ventilation apparatus according to an embodiment of the disclosure.
Figure 2:
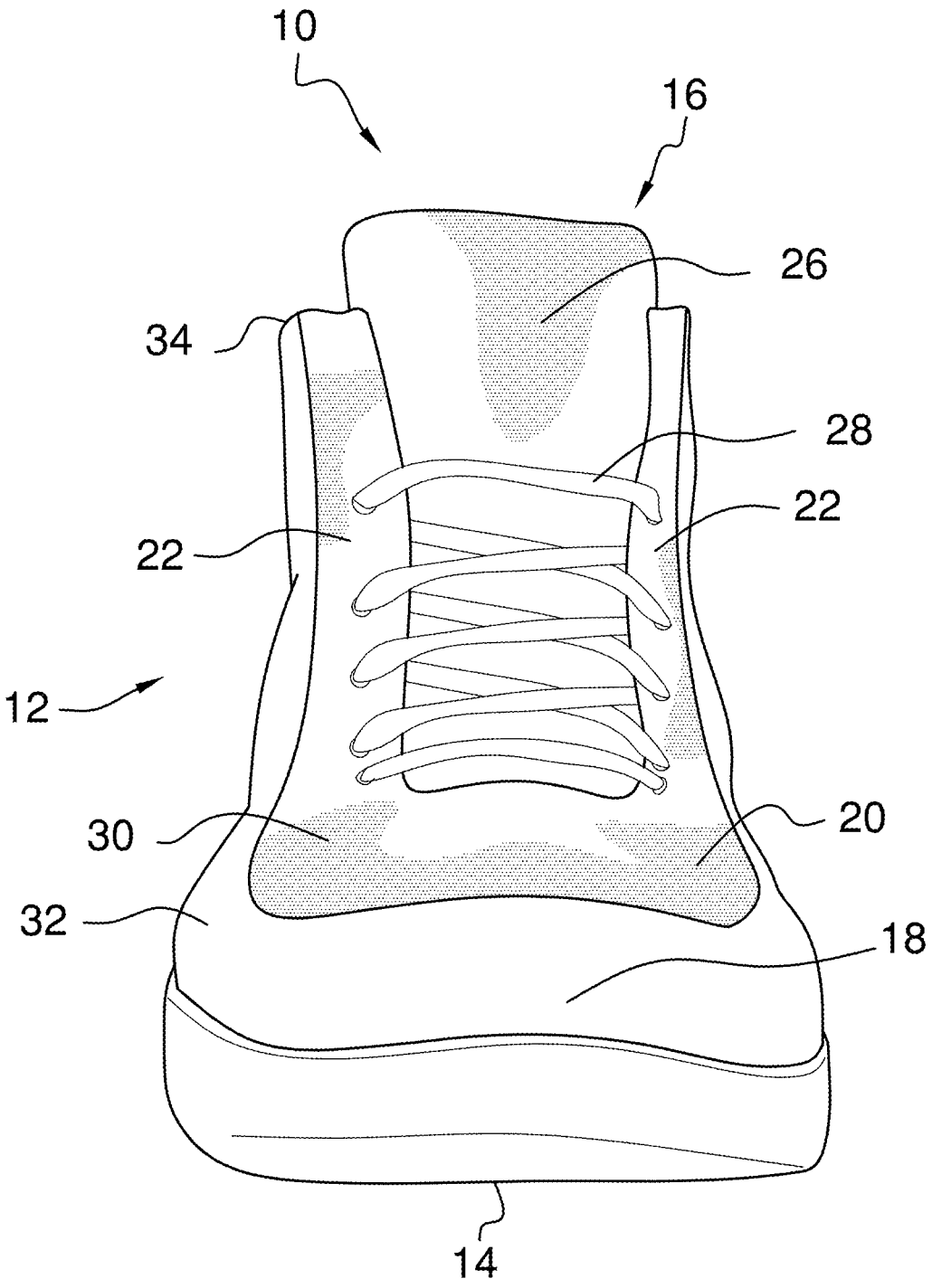
FIG. 2 is a front view of a shoe of an embodiment of the disclosure.
Figure 3:
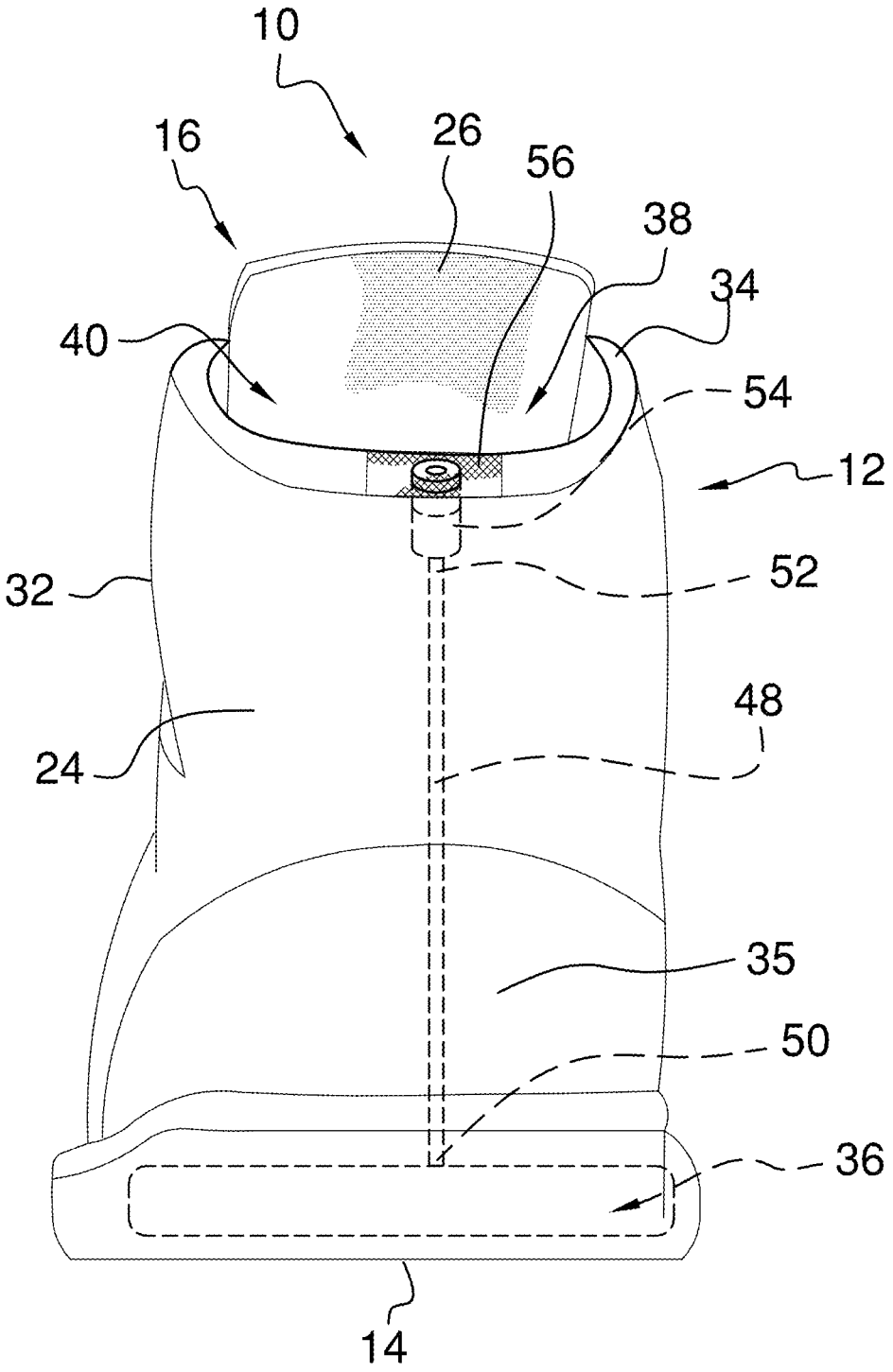
FIG. 3 is a back view of a shoe of an embodiment of the disclosure.
Figure 4:
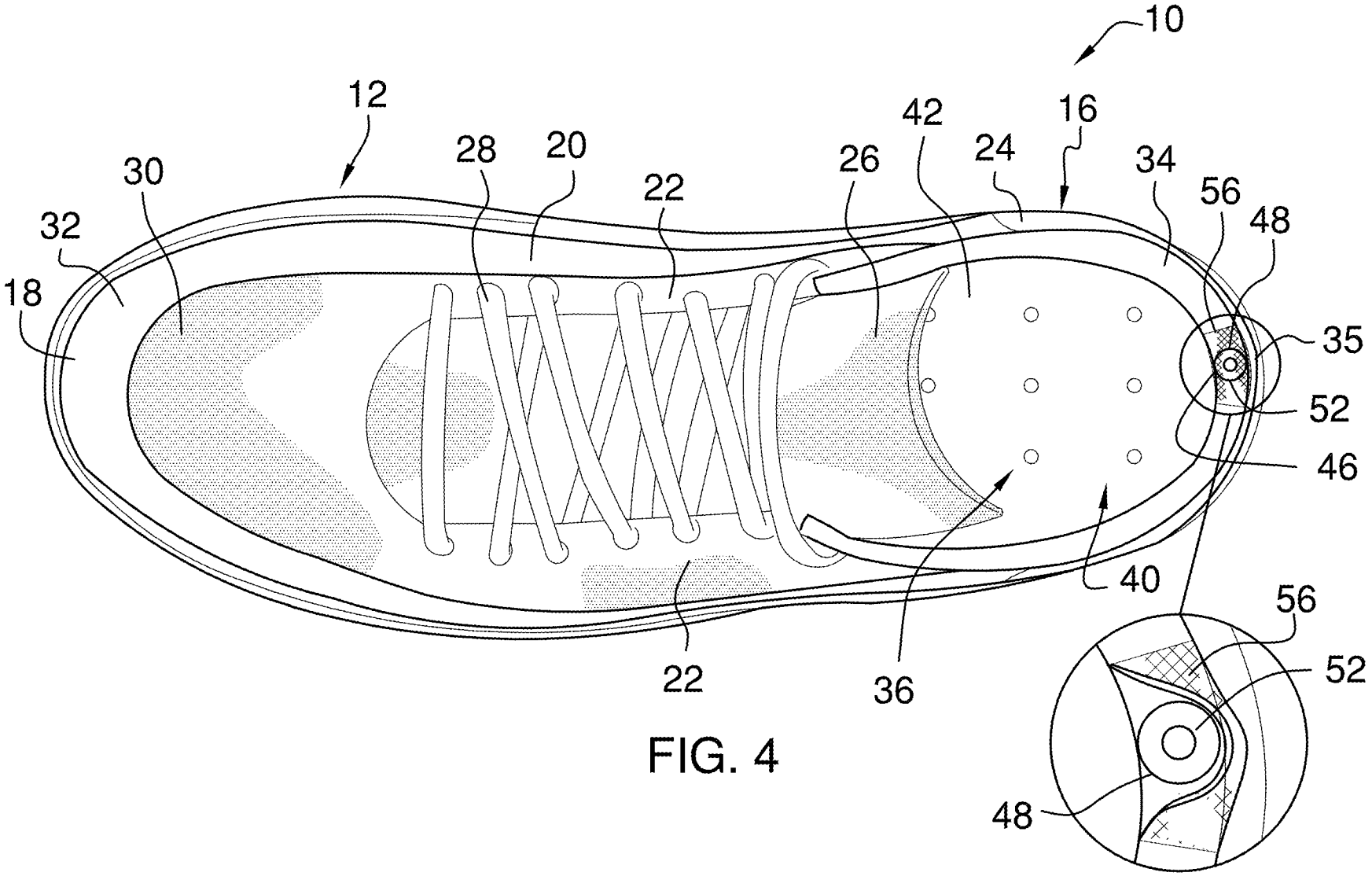
FIG. 4 is a top view of an embodiment of the disclosure.
Figure 5:
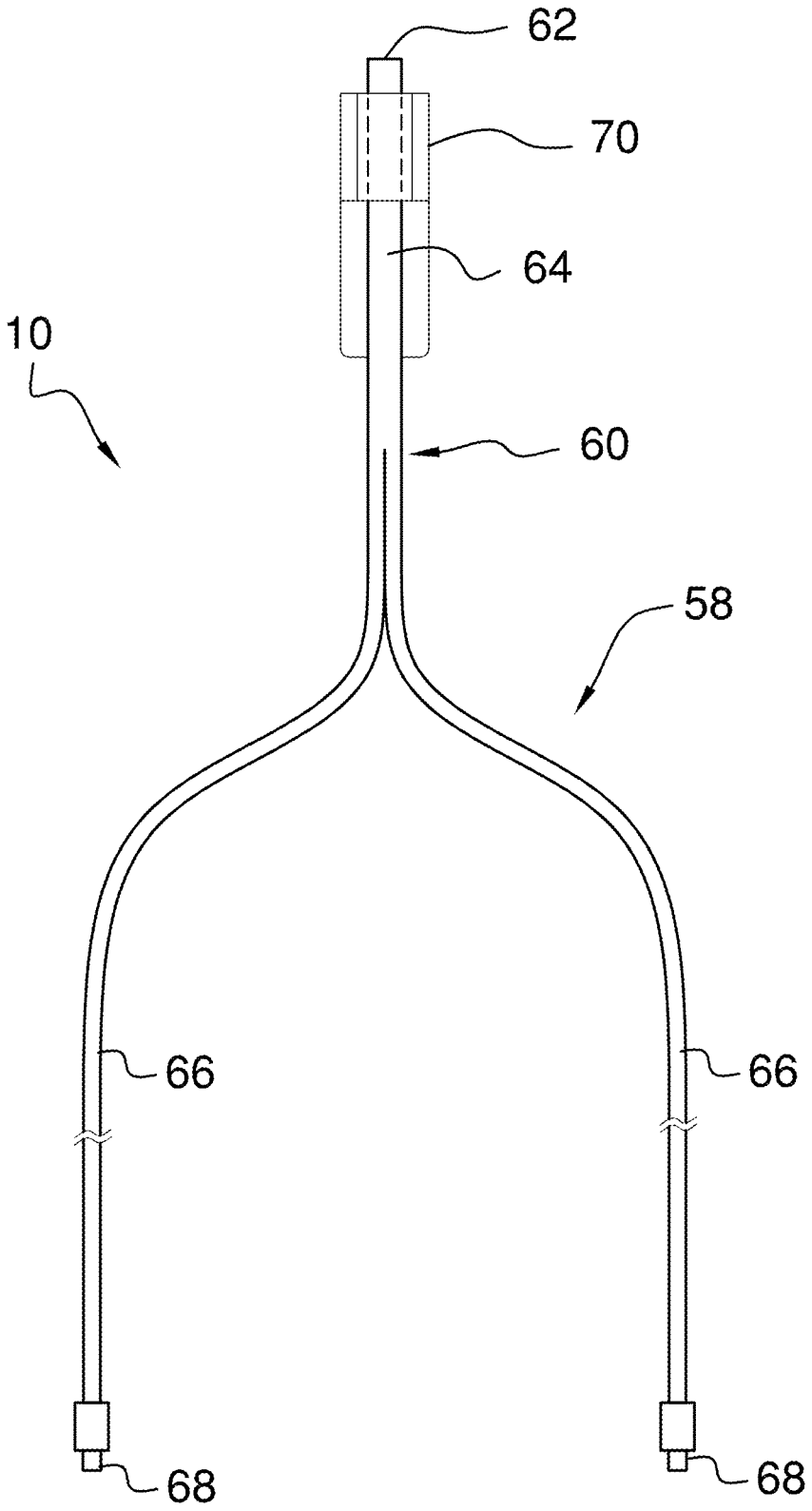
FIG. 5 is a front view of an extension tube apparatus of an embodiment of the disclosure.
Figure 6:
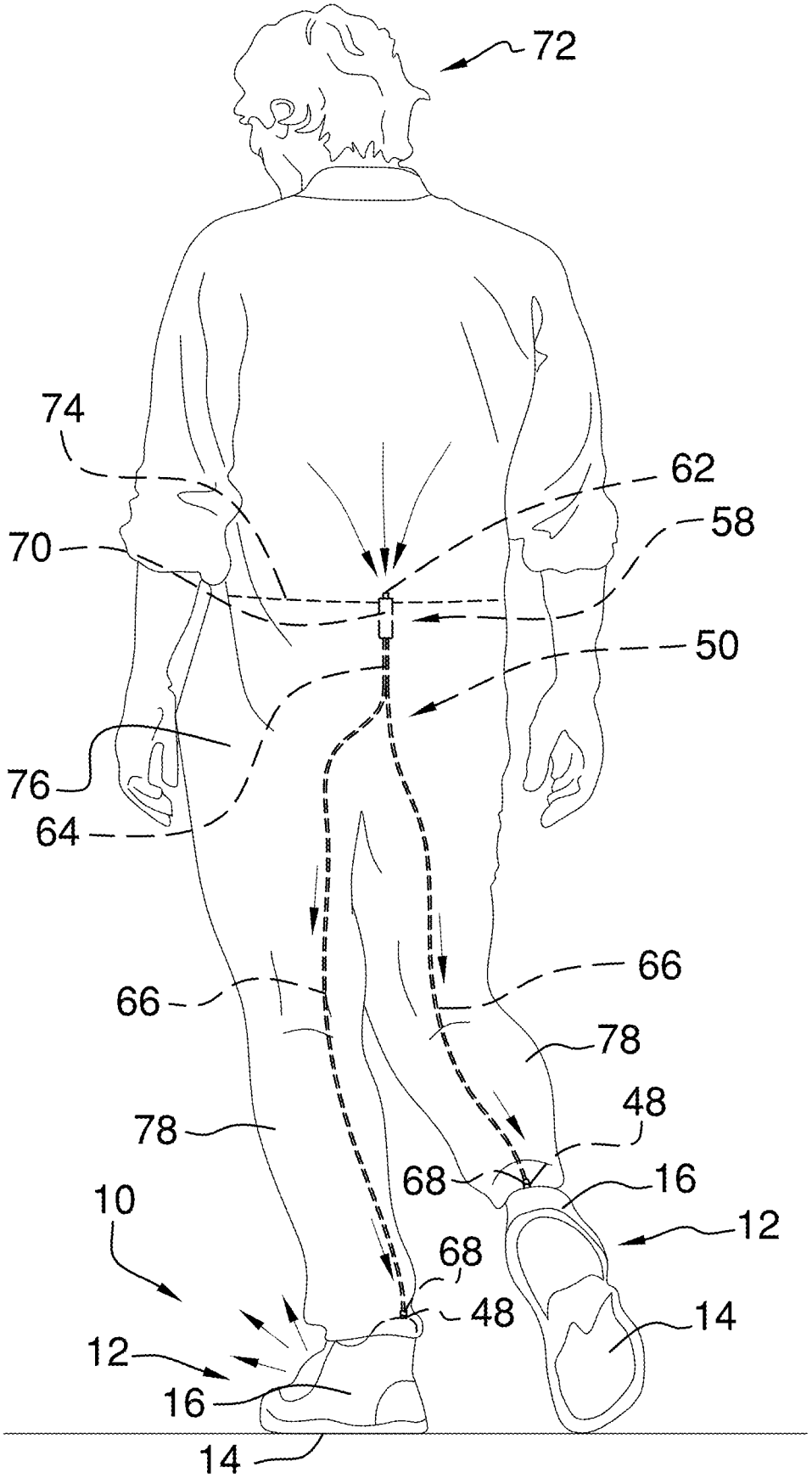
FIG. 6 is an in-use view of an embodiment of the disclosure.
Figure 7:
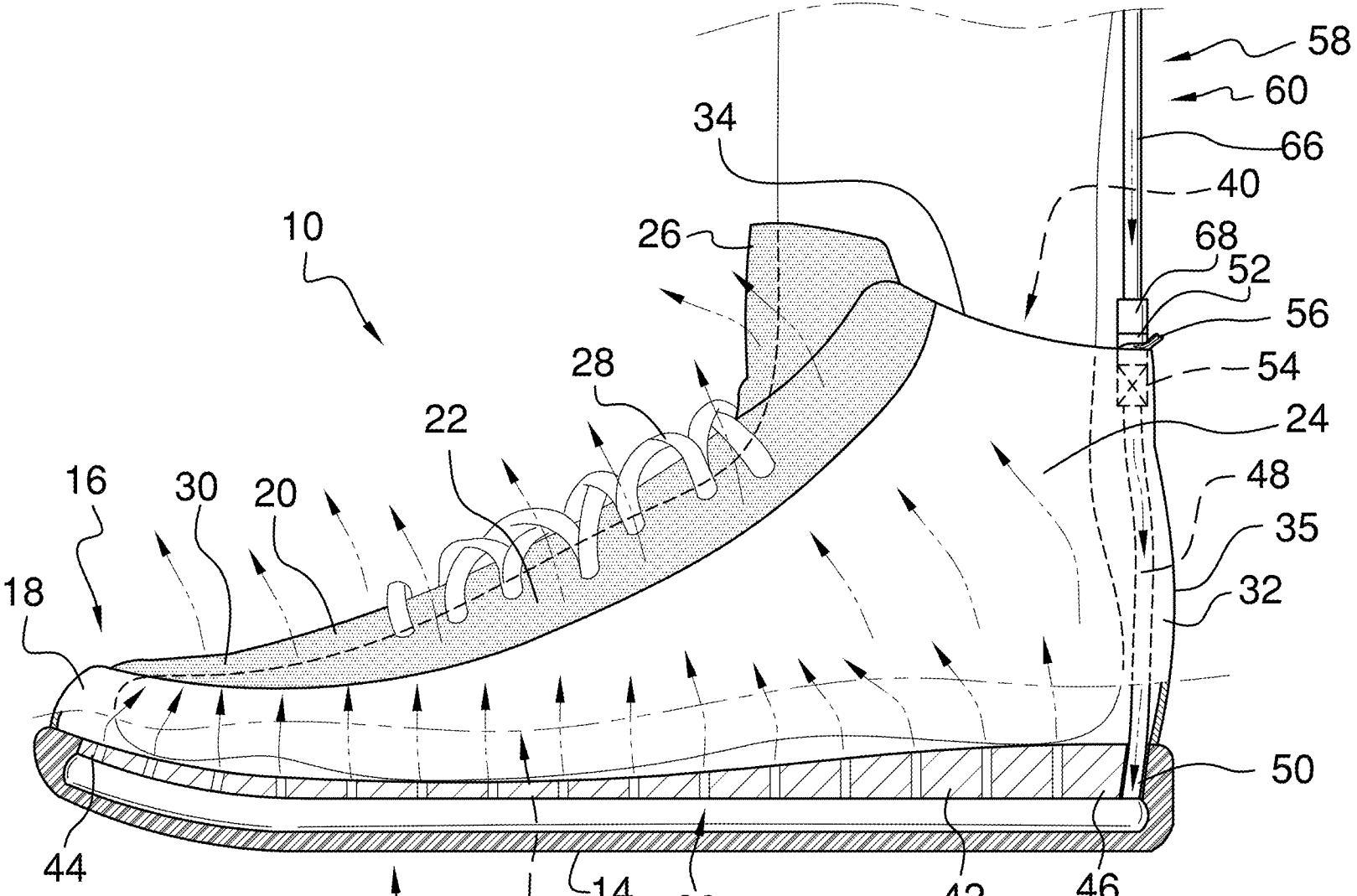
FIG. 7 is a side view of a shoe of an embodiment of the disclosure with a partial cross-section depicting a chamber formed between an outsole and an insole.

With reference now to the drawings, and in particular to FIGS. 1 through 7 thereof, a new personal ventilation device embodying the principles and concepts of an embodiment of the disclosure and generally designated by the reference numeral 10 will be described.

As best illustrated in FIGS. 1 through 7, the wearable ventilation apparatus 10 generally comprises a pair of shoes 12. Each shoe 12 comprises an outsole 14, an upper 16 mounted to the outsole 14, and an insole 42 mounted between the upper 16 and the outsole 14. A chamber 36 is defined between the insole 42 and the outsole 14, and a foot-containing space is defined between the insole 42 and the upper 16. The insole 42 has a plurality of apertures extending therethrough from the chamber 36 to the foot-containing space. The insole 42 is movable toward the outsole 14 to compress the chamber 36 and is biased to move away from the outsole 14 when released, expanding the chamber 36. The insole 42 comprises a resiliently deformable material such as rubber, silicone, or the like, which biases the insole 42 upwardly away from the outsole 14. As a user 72 wearing the shoe 12 places 28 weight on the insole 42 by stepping on a ground surface, the insole 42 moves toward the outsole 14, compressing the chamber 36. When the user 72 lifts the shoe 12, removing the weight from the insole 42, the insole 42 returns to its original position and expands the chamber 36. The apertures are distributed evenly between a front end 44 and a rear end 46 of the insole 42.

The upper 16 comprises a toe box 18, a vamp 20, a rear quarter 24, a pair of lace guards 22, and a tongue 26. The vamp 20 extends between the toe box 18 and around the lace guards 22 to the rear quarter 24. The lace guards 22 are attached to the vamp 20 and the rear quarter 24 and overlap the tongue 26. Laces 28 are attached to the lace guards 22 and may be cinched to pull the lace guards 22 toward each other. The upper 16 has a cuff 34 which defines an opening 40 to the foot-receiving space 38. The upper 16 comprises a first material and a second material. The tongue 26 is formed of the first material. The upper 16 also has a top-facing portion 30 which is formed of the first material and which extends from a top side of the toe box 18, over the vamp 20, and over the pair of lace guards 22. The upper 16 has a perimeter portion 32 which is attached to and surrounds the top-facing portion 30 and is formed of the second material. The upper 16 may have other shapes and structures sufficient for holding a foot between the upper 16 and the insole 42.

The first material is an air-permeable fabric material which freely permits air to flow from the foot-receiving space 38 through the air-permeable material to an external atmosphere. The air-permeable material may be a fabric with an open weave, for example. The second material may be an air-impermeable material such as leather, rubber, silicone, or the like. The second material may be another fabric material with a weave that is more closed than the open-weave fabric of the air-permeable material. In some embodiments, the air-permeable material is used for an entirety of the upper 16.

A shoe tube 48 extends between a first end 50 which is open at the chamber 36 and a second end 52 which is open to an external atmosphere such that the chamber 36 is in fluid communication with the external atmosphere via the shoe tube 48. The shoe tube 48 extends from the first end 50 to the second end 52 along a heel end 35 of the upper 16 to the cuff 34 of the upper 16. A one-way valve 54 is mounted to the shoe tube 48 and is configured to permit air to move only from the second end 52 of the shoe tube 48 to the first end 50 of the shoe tube 48.

A barrier filter 56 is positioned to cover the second end 52 of the shoe tube 48. The barrier filter 56 has openings sized to allow airflow therethrough and prevent particulate matter from entering the second end 52 of the shoe tube 48. The barrier filter 56 comprises a flexible mesh material which is coupled to the cuff 34 of the upper 16 and is movable away from the second end 52 of the shoe tube 48. In other embodiments, the barrier filter 56 may have a rigid structure and may be mounted to the shoe tube 48. In such embodiments, the barrier filter 56 may be pivotably, slidably, or otherwise movably coupled to the shoe tube 48 such that the barrier filter 56 may be moved away from the second end 52 of the shoe tube 48.

An extension tubing apparatus 58 is couplable to the second ends 52 of the shoe tubes 48 of the pair of shoes 12 to facilitate drawing air from within a space between a body of the user 72 and a clothing article of the user 72 to each shoe 12 during use. The extension tubing apparatus 58 comprises tubing 60 which couples to the shoe tubes 48 of the shoes 12 such that each shoe tube 48 is in fluid communication with an intake end 62 of the tubing 60. The tubing 60 comprises a supply tube 64 at the intake end 62 and a pair of branch tubes 66 coupled to the supply tube 64. Each branch tube 66 has a connection end 68 opposite the supply tube 64 which is couplable to the second end 52 of the shoe tube 48.

The connection ends 68 are shaped to be insertable into the second end 52 of the shoe tube 48 of an associated shoe 12 of the pair of shoes 12 in order to couple the branch tube 66 to the respective shoe tube 48. In other embodiments, threaded connectors, clamps, latches, or other suitable fasteners may be used to attach the connection ends 68 of the tubing 60 to the shoe tubes 48.

The extension tubing apparatus 58 also includes a tubing mount 70 coupled to the tubing 60 near the intake end 62. The tubing mount 70 comprises a clip which is shaped to hook onto a waistband or the like. In other embodiments, the tubing mount 70 may comprise another fastener for securing the intake end 62 of the tubing 60 to clothing of the user 72 or the body of the user 72. For example, the tubing mount 70 may comprise a hook, a clamp, a hook-and-loop fastener, or the like. In some embodiments, separate extension tube apparatuses may be used for the separate shoe tubes 48, and such separate extension tube apparatuses may include their own mounts.

In use, the shoes 12 may be used without the extension tubing apparatus 58 to ventilate the foot-receiving space 38 while the user 72 wears the shoes 12. When the user 72 steps on the floor or ground while wearing one of the shoes 12, the foot of the user 72 compresses the chamber 36 such that air held in the chamber 36 is expelled through the apertures into the foot-receiving space 38, which may then release from the foot-receiving space 38 via the air-permeable material of the shoe 12 and the opening 40 defined by the cuff 34. Air does not expel through the second end 52 of the tube because the one-way valve 54 prevents airflow in that direction. When the user 72 lifts the foot wearing the shoe 12, the insole 42 springs back such that the chamber 36 expands, forming a vacuum which draws air through the second end 52 of the tube through the one-way valve 54 into the chamber 36.

The extension tubing apparatus 58 may be coupled to the shoe tubes 48 and the intake end 62 of the tubing 60 may be mounted on a waistband 74 or other suitable mounting location between the body of the user 72 and an article of clothing worn by the user 72. The branches of the tubing 60 may be threaded through pant legs 78 of pants 76 worn by the user 72. The user 72 may use the extension tubing apparatus 58 in this manner to cool the body of the user 72 near the intake end 62 of the tubing 60 by drawing air into the chambers 36 of the shoes 12 which has been warmed by body heat from the user 72 and trapped by thermally insulative clothing worn by the user 72. When the warm air is drawn away from near the body of the user 72, cooler air from outside of the clothing may be drawn through a neck hole, sleeve holes, and the like. The user 72 may also use the extension tubing apparatus 58 in this manner to warm the feet of the user 72, which may be desirable in situations when the feet of the user 72 are colder than other areas of the body of the user 72.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wearable ventilation apparatus comprising:

a shoe comprising:

an outsole;

an upper mounted atop the outsole;

an insole mounted between the upper and the outsole, a chamber being defined between the insole and the outsole, a foot-containing space being defined between the insole and the upper, the insole having a plurality of apertures extending therethrough from the chamber to the foot-containing space, the insole being movable toward the outsole to compress the chamber, the insole being biased away from the outsole, the plurality of apertures being distributed evenly between a front end and a rear end of the insole;

a shoe tube extending between a first end at the chamber and a second end which is open to an external atmosphere such that the chamber is in fluid communication with the external atmosphere via the shoe tube;

a one-way valve mounted to the shoe tube, the one-way valve being configured to permit air to move only from the second end of the shoe tube to the first end of the shoe tube; and wherein the upper comprising a toe box, a vamp, a rear quarter, a pair of lace guards, and a tongue, the upper comprising a first material and a second material, the tongue being formed of the first material, the upper having a top-facing portion which is formed of the first material and extends from a top side of the toe box, over the vamp, and over the pair of lace guards, the upper having a perimeter portion which is attached to and surrounds the top-facing portion and is formed of the second material, the first material being an air-permeable fabric material.

2. The wearable ventilation apparatus of claim 1, wherein the upper comprises an air-permeable material configured to permit airflow out of the foot-receiving space through the air-permeable material to the external atmosphere.

3. The wearable ventilation apparatus of claim 1, wherein the insole comprises a resiliently deformable material, the resiliently deformable material biasing the insole away from the outsole.

4. The wearable ventilation apparatus of claim 1, wherein the shoe tube extends from the first end to the second end along a heel end of the upper to a cuff of the upper.

5. The wearable ventilation apparatus of claim 1, wherein the shoe further comprises a barrier filter positioned to cover the second end of the shoe tube, the barrier filter having openings sized to allow airflow therethrough and prevent particulate matter from entering the second end of the shoe tube.

6. The wearable ventilation apparatus of claim 5, wherein the barrier filter is coupled to the upper, the barrier filter being movable away from the second end.

7. The wearable ventilation apparatus of claim 6, wherein the barrier filter comprises a flexible mesh material.

8. The wearable ventilation apparatus of claim 1, further comprising an extension tubing apparatus which is couplable to the second end of the shoe tube, the extension tubing apparatus comprising tubing which extends from an intake end to a connection end, the connection end being configured to couple to the second end of the shoe tube such that the shoe tube is in fluid communication with the intake end of the tubing.

9. The wearable ventilation apparatus of claim 8, wherein the extension tubing apparatus further comprises a tubing mount coupled to the tubing, the tubing mount being configured to secure the intake end of the tubing to a clothing article of a user.

10. The wearable ventilation apparatus of claim 9, wherein the tubing mount comprises a clip configured to hook onto a waistband.

11. The wearable ventilation apparatus of claim 1, wherein the shoe is one of a pair of shoes, each shoe of the pair of shoes comprising:

an outsole;

an upper mounted atop the outsole;

an insole mounted between the upper and the outsole, a chamber being defined between the insole and the outsole, a foot-containing space being defined between the insole and the upper, the insole having a plurality of apertures extending therethrough from the chamber to the foot-containing space, the insole being movable toward the outsole to compress the chamber, the insole being biased away from the outsole, the plurality of apertures being distributed evenly between a front end and a rear end of the insole;

a shoe tube extending between a first end at the chamber and a second end which is open to an external atmosphere such that the chamber is in fluid communication with the external atmosphere via the shoe tube; and a one-way valve mounted to the shoe tube, the one-way valve being configured to permit air to move only from the second end of the shoe tube to the first end of the shoe tube.

12. The wearable ventilation apparatus of claim 11, further comprising an extension tubing apparatus which is couplable to the second ends of the shoe tubes of the pair of shoes, the extension tubing apparatus comprising tubing configured to couple to the shoe tubes of the pair of shoes such that each shoe tube is in fluid communication with an intake end of the tubing, the tubing comprising a supply tube at the intake end and a pair of branch tubes coupled to the supply tube, each branch tube of the pair of branch tubes having a connection end opposite the supply tube, the connection end being shaped to be insertable into the second end of the shoe tube of an associated shoe of the pair of shoes to couple the branch tube to the shoe tube of the associate shoe.

13. The wearable ventilation apparatus of claim 12, wherein the extension tubing apparatus further comprises a tubing mount coupled to the tubing, the tubing mount being configured to secure the intake end of the tubing to a clothing article of a user.

14. The wearable ventilation apparatus of claim 13, wherein the tubing mount comprises a clip configured to hook onto a waistband.

15. A wearable ventilation apparatus comprising:

a pair of shoes, each shoe of the pair of shoes comprising:

an outsole;

an upper mounted atop the outsole, the upper comprising a toe box, a vamp, a rear quarter, a pair of lace guards, and a tongue, the upper comprising a first material and a second material, the tongue being formed of the first material, the upper having a top-facing portion which is formed of the first material and extends from a top side of the toe box, over the vamp, and over the pair of lace guards, the upper having a perimeter portion which is attached to and surrounds the top-facing portion and is formed of the second material, the first material being an air-permeable fabric material;

an insole mounted between the upper and the outsole, a chamber being defined between the insole and the outsole, a foot-containing space being defined between the insole and the upper, the insole having a plurality of apertures extending therethrough from the chamber to the foot-containing space, the insole being movable toward the outsole to compress the chamber, the insole being biased away from the outsole, the insole comprising a resiliently deformable material, the plurality of apertures being distributed evenly between a front end and a rear end of the insole;

a shoe tube extending between a first end at the chamber and a second end which is open to an external atmosphere such that the chamber is in fluid communication with the external atmosphere via the shoe tube, the shoe tube extending from the first end to the second end along a heel end of the upper to a cuff of the upper;

a one-way valve mounted to the shoe tube, the one-way valve being configured to permit air to move only from the second end of the shoe tube to the first end of the shoe tube; and a barrier filter positioned to cover the second end of the shoe tube, the barrier filter having openings sized to allow airflow therethrough and prevent particulate matter from entering the second end of the shoe tube, the barrier filter being coupled to the cuff of the upper, the barrier filter being movable away from the second end, the barrier filter comprising a flexible mesh material; and an extension tubing apparatus which is couplable to the second ends of the shoe tubes of the pair of shoes, the extension tubing apparatus comprising:

tubing configured to couple to the shoe tubes of the pair of shoes such that each shoe tube is in fluid communication with an intake end of the tubing, the tubing comprising a supply tube at the intake end and a pair of branch tubes coupled to the supply tube, each branch tube of the pair of branch tubes having a connection end opposite the supply tube, the connection end being shaped to be insertable into the second end of the shoe tube of an associated shoe of the pair of shoes to couple the branch tube to the shoe tube of the associate shoe; and a tubing mount coupled to the tubing, the tubing mount comprising a clip configured to hook onto a waistband, the tubing mount being positioned adjacent to the intake end of the tubing.

* * * * *